US010851991B2

(12) United States Patent
Bertelli

(10) Patent No.: US 10,851,991 B2
(45) Date of Patent: Dec. 1, 2020

(54) METHOD FOR REDUCING HARMFUL GAS EMISSIONS FROM A GAS-FIRED SEALED COMBUSTION CHAMBER FORCED-DRAUGHT BOILER AND BOILER SO OBTAINED

(71) Applicant: BERTELLI & PARTNERS S.R.L., Angiari (IT)

(72) Inventor: Pierluigi Bertelli, Bardolino (IT)

(73) Assignee: BERTELLI & PARTNERS S.R.L., Angiari (IT)

( * ) Notice: Subject to any disclaimer, the term of this patent is extended or adjusted under 35 U.S.C. 154(b) by 98 days.

(21) Appl. No.: 15/767,149

(22) PCT Filed: Oct. 14, 2016

(86) PCT No.: PCT/IB2016/001493

§ 371 (c)(1),
(2) Date: Apr. 10, 2018

(87) PCT Pub. No.: WO2017/068407

PCT Pub. Date: Apr. 27, 2017

(65) Prior Publication Data

US 2018/0299122 A1 Oct. 18, 2018

(30) Foreign Application Priority Data

Oct. 19, 2015 (IT) ..... UB2015A5050

(51) Int. Cl.
*F23C 9/00* (2006.01)

(52) U.S. Cl.
CPC ..... *F23C 9/00* (2013.01); *F23C 2202/10* (2013.01); *F23C 2202/30* (2013.01);
(Continued)

(58) Field of Classification Search
CPC ..... F23C 9/00; F23C 22/10; F23C 29/09
(Continued)

(56) References Cited

U.S. PATENT DOCUMENTS 4,725,223 A * 2/1988 Coppin ..... F23G 7/065 422/173
4,926,765 A * 5/1990 Dreizler ..... F23C 9/00 110/234

(Continued)

FOREIGN PATENT DOCUMENTS

EP 0271111 A2 6/1988
EP 1504804 A1 2/2005

(Continued)

OTHER PUBLICATIONS

International Search Report and Written Opinion dated Jan. 31, 2017 for PCT/IB2016/001493 to Bertelli & Partners S.R.L. filed Oct. 14, 2016.

*Primary Examiner* — Edelmira Bosques
*Assistant Examiner* — Nikhil P Mashruwala
(74) *Attorney, Agent, or Firm* — Vorys, Sater, Seymour and Pease LLP

(57) ABSTRACT

A method for reducing harmful gas emissions from a gas-fired boiler including a sealed forced-draught combustion chamber in which there is a burner to which there leads a first conduit for drawing in combustion air and from which there departs a second conduit for the discharge of combustion flue gases. Provision is made for drawing off a portion of the flue gases or exhaust gases from the second conduit and injecting it into the combustion air to reduce the percentage of atmospheric oxygen present in that combustion air and consequently reduce the production of harmful gases in the combustion flue gases. A boiler operating according to the aforesaid method is also disclosed.

15 Claims, 9 Drawing Sheets

(52) U.S. Cl.
CPC ..... *F23C 2202/50* (2013.01); *F23C 2900/09002* (2013.01); *F23N 2221/12* (2020.01)

(58) Field of Classification Search
USPC ..... 431/9
See application file for complete search history.

(56) References Cited

U.S. PATENT DOCUMENTS 5,623,813 A * 4/1997 Ma ..... B65D 25/107 53/467
6,095,792 A * 8/2000 Berger ..... F23C 9/00 431/115
6,599,119 B1 * 7/2003 Wood ..... F23C 9/08 431/115
6,609,907 B1 * 8/2003 Wood ..... F23C 9/08 110/204
7,425,127 B2 * 9/2008 Zinn ..... F23C 5/24 431/115
8,083,517 B2 * 12/2011 Newby ..... F23N 5/02 431/12
9,593,846 B2 * 3/2017 Kuczynski ..... F23N 3/085
2002/0090583 A1 * 7/2002 Cain ..... F23N 1/02 431/2
2013/0340658 A1 * 12/2013 Liao ..... F02D 41/1454 110/186

FOREIGN PATENT DOCUMENTS

EP 1504804 A1 * 9/2005 ..... F23C 9/06
WO 9961839 A1 12/1999
WO 2011139272 A1 11/2011

* cited by examiner

METHOD FOR REDUCING HARMFUL GAS EMISSIONS FROM A GAS-FIRED SEALED COMBUSTION CHAMBER FORCED-DRAUGHT BOILER AND BOILER SO OBTAINED

CROSS-REFERENCE TO RELATED APPLICATIONS

This is a § 371 National Stage Application of International Application No. PCT/IB2016/001493 filed on Oct. 14, 2016, claiming the priority of Italian Patent Application No. UB2015A005050 filed on Oct. 19, 2015.

This invention relates to a method for reducing harmful gas emissions from gas-fired boilers having a sealed forced-draught combustion chamber and a boiler operating according to the said method, in accordance with the corresponding independent claims.

The invention relates to a boiler with a sealed forced-draught combustion chamber, in which the said boiler may have a burner of the atmospheric type where the combustion air in an air-gas mixture is predominantly secondary or the air which is already in the combustion chamber does not already form part of the mixture before entering therein; this air is delivered via piping from the outside of the boiler to the combustion area where a burner is present. The invention also relates to the case of a boiler using a suitably developed burner (specifically known as a low-NOx burner) for reducing NOx emissions, and to predominantly primary air and improved mixing in comparison with those of the "atmospheric" type.

As is known, the requirement that boilers of the aforesaid type usually in use in buildings for domestic use should comply with increasingly restrictive parameters with regard to harmful gas emissions (mainly NOx or nitrogen oxides) and performance is increasing. Recent European regulations are tending in this direction.

With specific reference to the problem of reducing harmful gas emissions, only solutions equipped with premixed combustion or intermediate solutions including those with an atmospheric burner and those with premixed combustion, defined as "low NOx", based on an improved mixing technique (in comparison with atmospheric combustion), and other techniques such as cooling the burner flame, are available on the market. Although they achieve the object, these intermediate solutions nevertheless have a high cost which limits their extensive use, to the advantage of premixed applications, also because of the need to cool the burner through water circulating within it (making construction more expensive). The most recent regulation restrictions relating to harmful emissions no longer permit the use of equipment with an atmospheric burner, given that it is impossible to reduce the NOx level below the imposed limits through the techniques in use.

It is also known that combustion conducted in an environment having an oxygen concentration below atmospheric (approximately 21%), even at a very high temperature (which encourages the formation of nitrogen oxides), limits the production or generation of these nitrogen oxides (NOx).

Applications in which the burner-combustion chamber assembly is designed with a view to causing some (uncontrolled) part of the combustion products to be recirculated within the combustion chamber itself by working on the geometry, with effect of diluting the mixture, reducing the formation of NOx, are also known.

However, apart from possible variations in the process and the result, these applications have a high cost to the user (for reasons of a construction nature). Also, this principle based on the recycling of combustion products in the combustion chamber is difficult (or impossible) to achieve technically in a low cost application, such as for example a wall-mounted gas-fired boiler with a burner of the atmospheric type.

The object of this invention is to provide a method for reducing the generation of harmful emissions in a boiler of the abovementioned type, and to provide a boiler operating according to this method which uses the knowledge mentioned above so that the boiler is able to function in such a way as to limit generation of the said harmful emissions.

In particular the object of the invention is that of providing a method through which it is possible to achieve the aforesaid reduction in harmful emissions (mainly NOx) in a controlled way which can be adjusted during the stage of manufacturing the equipment, installation of the equipment or during its use, manually, semi-automatically or automatically.

Another object is to provide a boiler of the aforesaid type which does not give rise to excessively high costs for the end user.

Another object is to provide a boiler of the type mentioned in which the reduction in harmful gas emissions is achieved safely and reliably over time.

This and other objects which will be obvious to those skilled in the art will be achieved through a method and device according to the corresponding appended independent claims.

For a better understanding of this invention the following drawings are provided purely by way of non-limiting example, in which.

Figure 1:
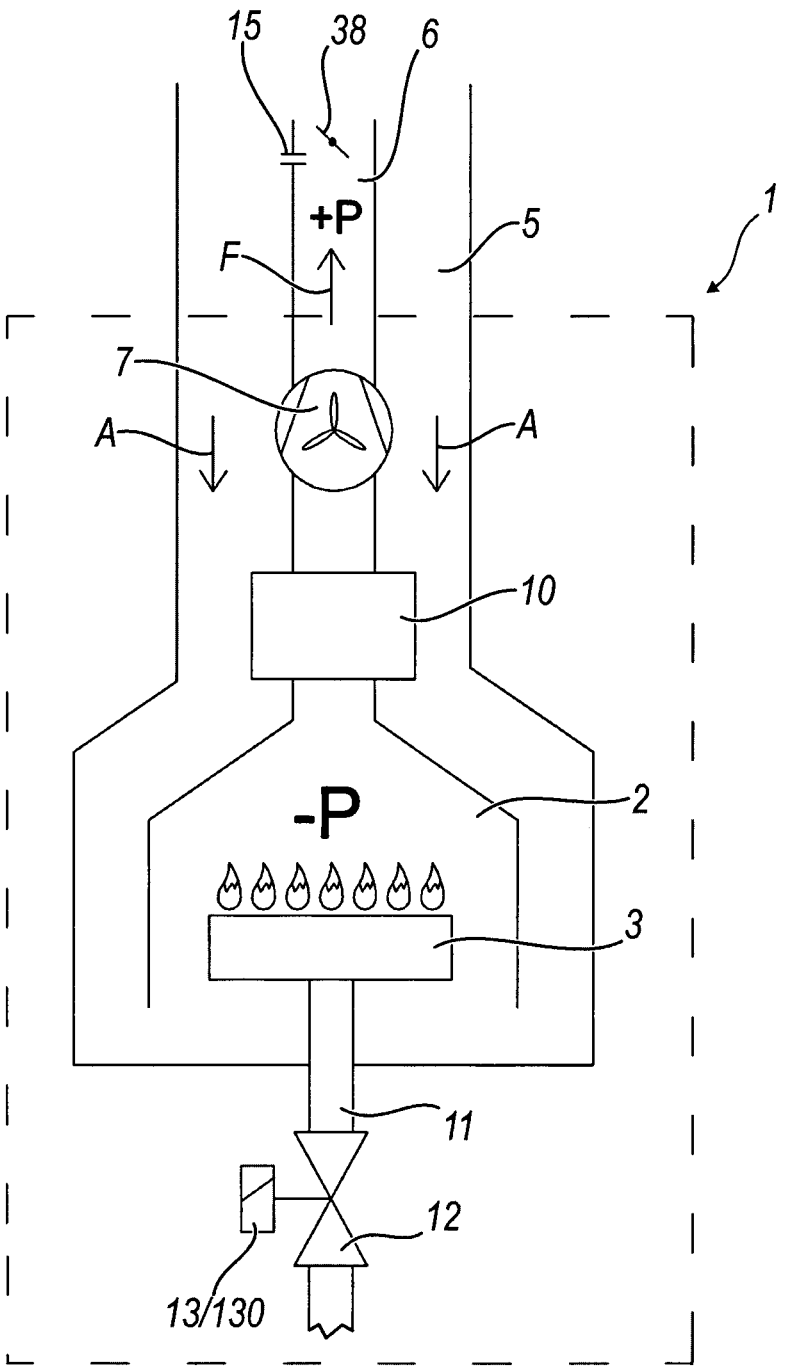
FIG. 1 shows diagrammatically a first embodiment of a boiler of the atmospheric burner type constructed according to this invention.
Figure 2:
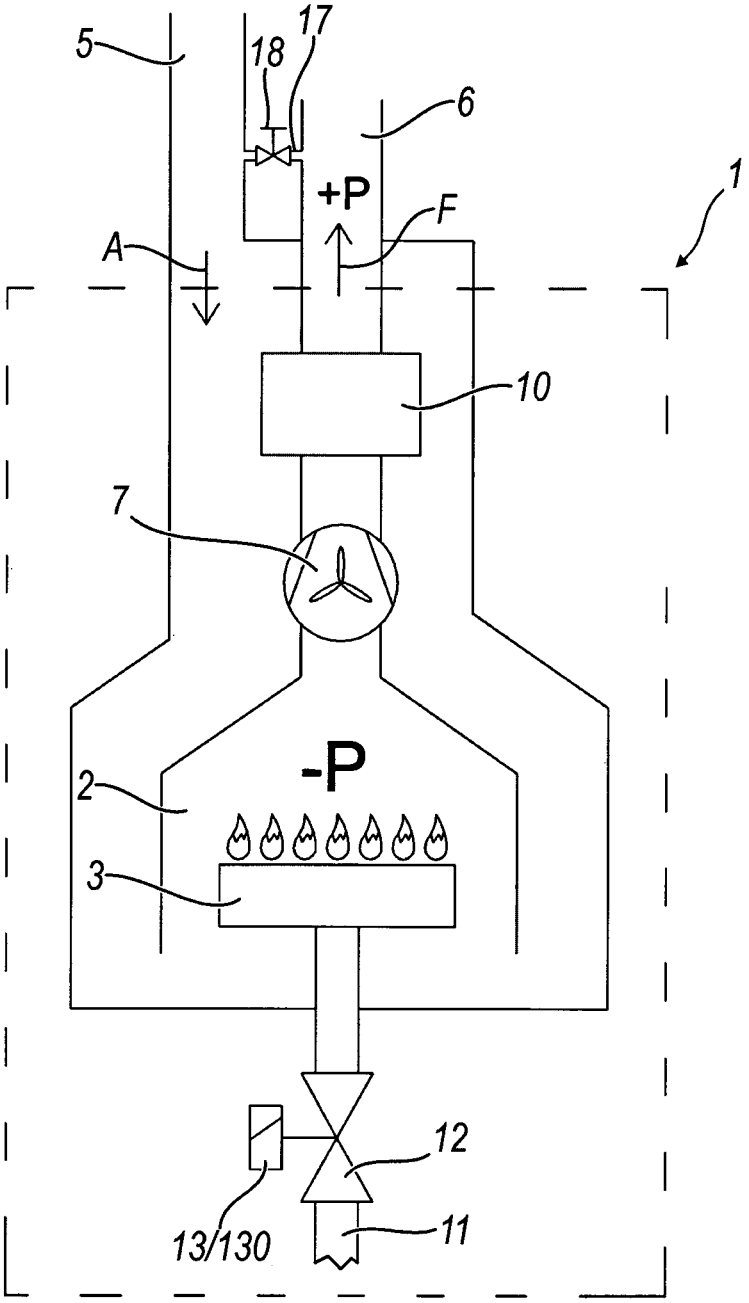
FIG. 2 illustrates a second embodiment of the boiler in FIG. 1.

With reference to the said FIGS. 1 to 6 a gas boiler 1 according to the invention comprises a sealed forced-draught combustion chamber 2 in which there is a burner 3. Combustion air A reaches this chamber 2 through a first (feed) conduit 5 and a second (exhaust) conduit 6 to carry away the flue gases or combustion products F from that chamber leads away from chamber 2. Conduits 5 and 6 open towards the external environment in which boiler 1 is installed, an environment which is a domestic environment. In FIGS. 1, 4, 5 and 6 conduits 5 and 6 are coaxial, in FIGS. 2 and 3 first conduit 5 is separate from second conduit 6. In these FIGS. 2, 3 the separation is outside gas boiler 1, but this separation may also be within the boiler itself, which in such situation will have two connecting holes in its outer envelope for the feed and discharge conduits without the assistance of an external separator. Such a solution is also envisaged according to the invention.

Along second conduit or exhaust conduit 6 there is a conventional fan 7, and a post-condenser 10 of a conventional type (to increase efficiency), may be located between this and combustion chamber 2.

Burner 3 is connected to a gas feed conduit 11 on which is located a valve 12 controlled by a organ 13 (for example), which may be mechanical and operated manually (such as by a handle) or operated electrically (with a relay closing valve 12) or by an automatic electronic device controlling the equipment (130).

In exhaust conduit 6 there is a generally positive pressure, while in the feed conduit or first conduit 5 there is a generally negative pressure; in each case the pressure difference between conduit 6 and conduit 5 is always positive. This situation (pressure difference) is made use of by the invention which provides for a connection between first conduit 5 and second conduit 6 to allow a portion of exhaust gas F to be transferred into the combustion air directed towards combustion chamber 2 before it reaches the latter. This portion of flue gases reduces the oxygen content of the combustion air and as a consequence results in a reduction in the nitrogen oxides generated during combustion.

Figure 9:
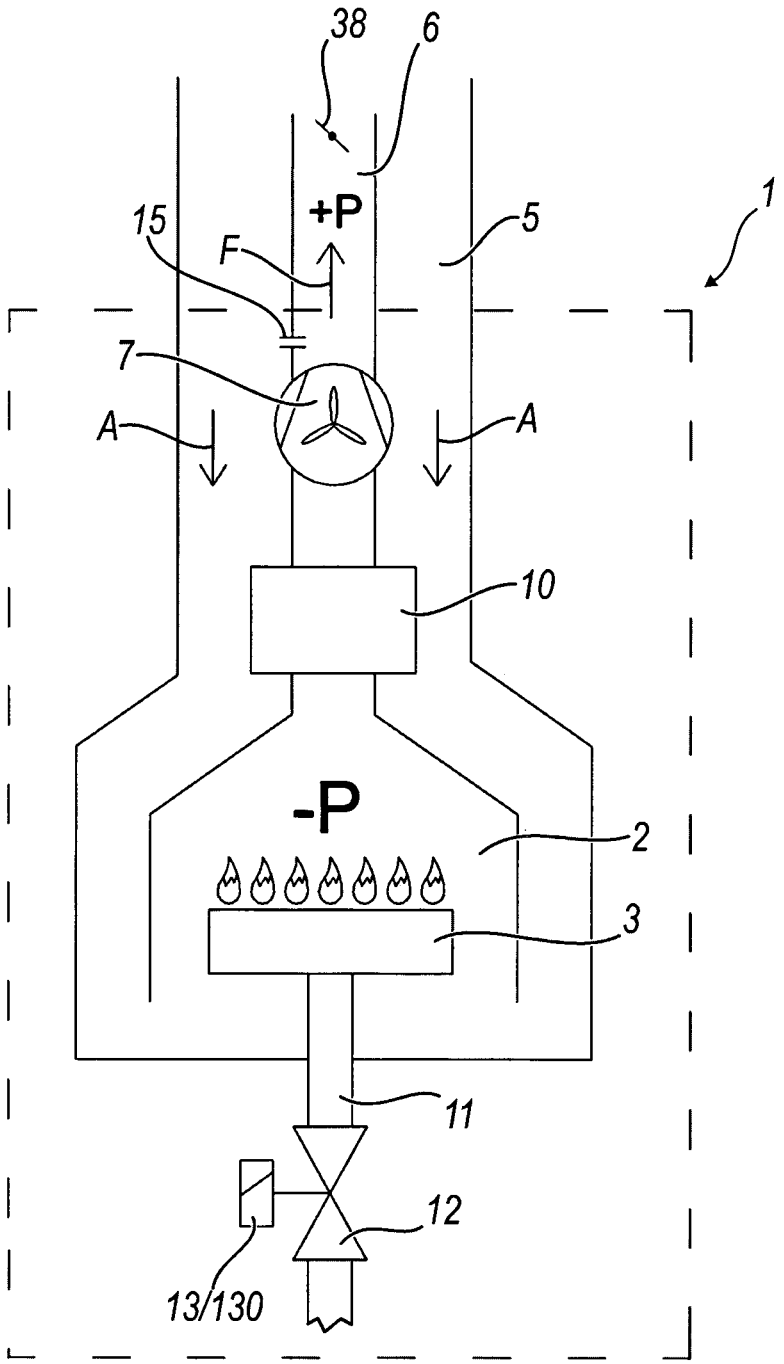
FIG. 9 shows diagrammatically a further embodiment of a boiler according to the invention.

More particularly the connection between first conduit 5 and second conduit 6 may be made by connecting them through an opening 15, close to fan 7 (FIG. 9) or at a greater distance therefrom (FIG. 1): thanks to the abovementioned pressure difference between the said conduits some of the flue gases pass from exhaust conduit 6 to feed conduit 5. The flow or quantity of flue gases F passing from one conduit to the other is determined by the cross-section of opening 15 in the case in point (in addition to the pressure difference itself).

As an alternative the two conduits 5 and 6 are connected together by a connecting conduit 17 on which a valve member 18 is fitted. This solution is mainly used in the case where the abovementioned two conduits are separate (FIGS. 2 and 3), but may also be used in the case of coaxial conduits (FIG. 4).

Figure 3:
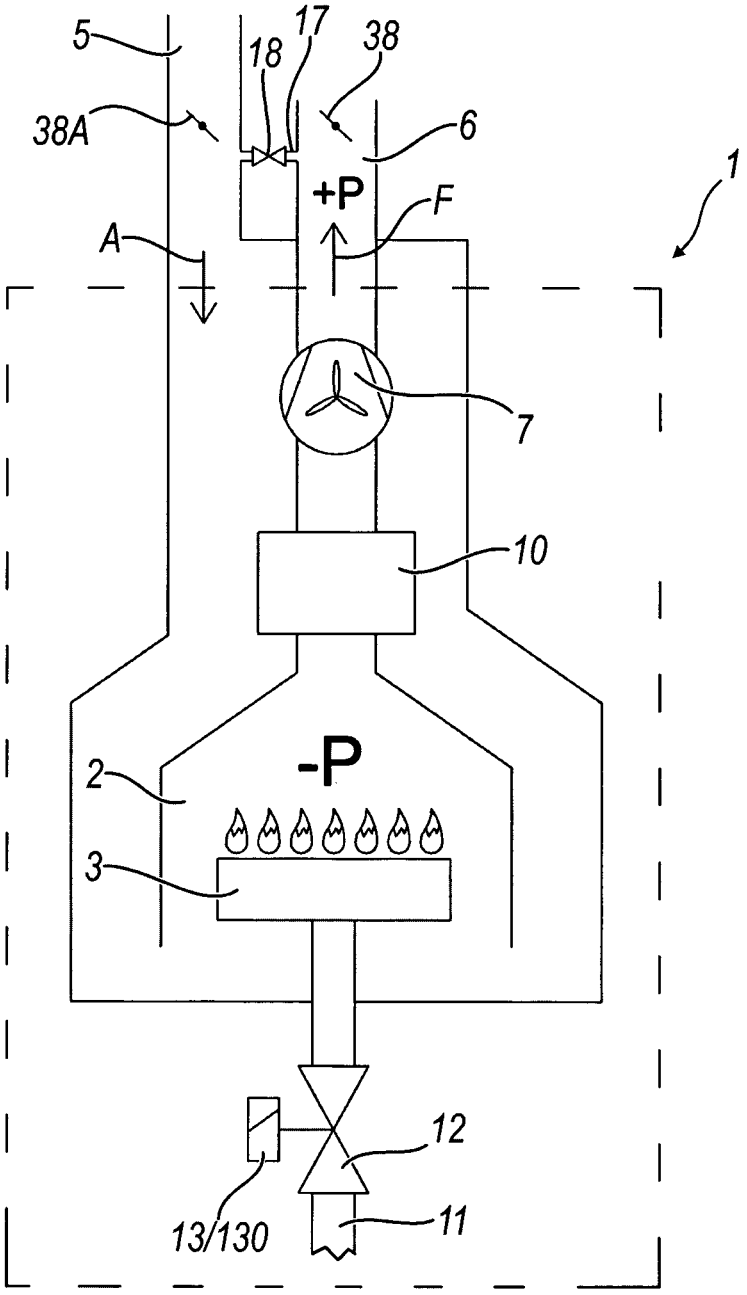
FIG. 3 shows diagrammatically a third embodiment of the boiler in FIG. 1.
Figure 4:
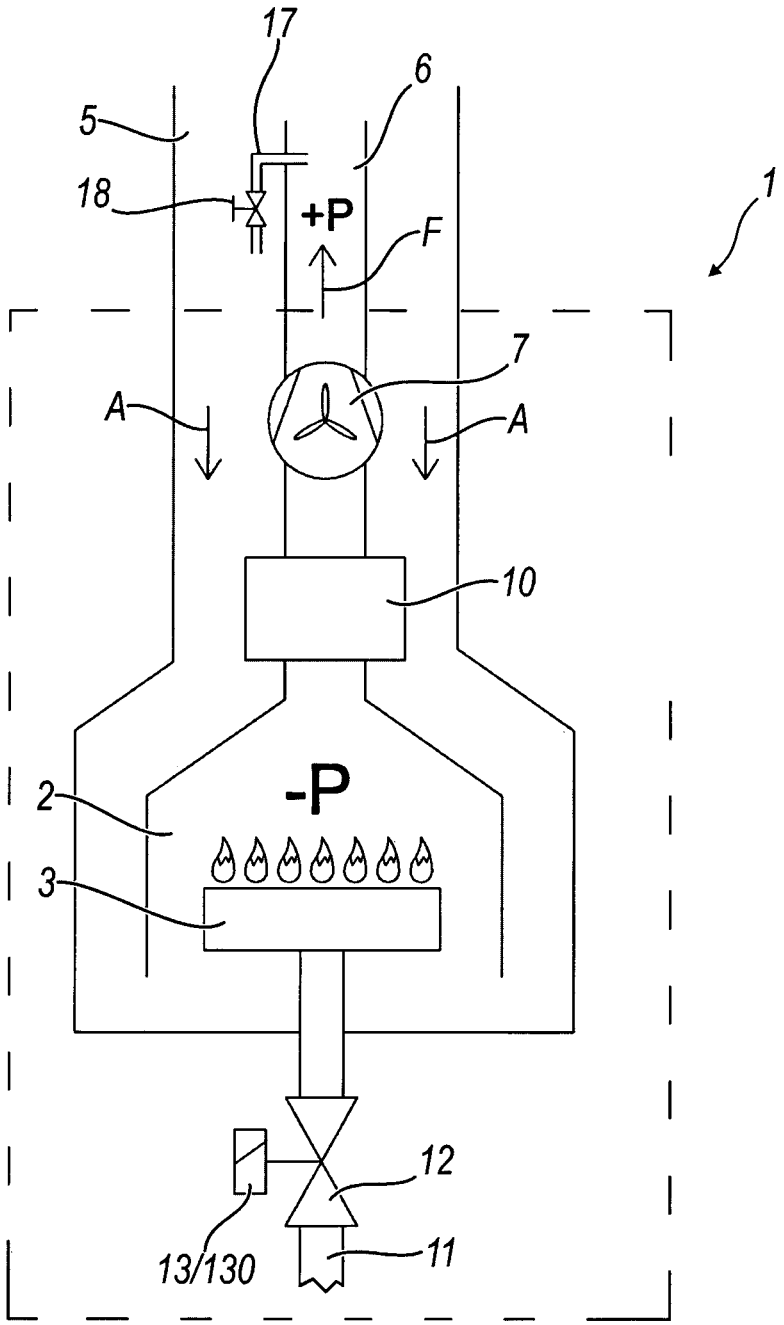
FIG. 4 shows diagrammatically a fourth embodiment of the boiler in FIG. 1.
Figure 5:
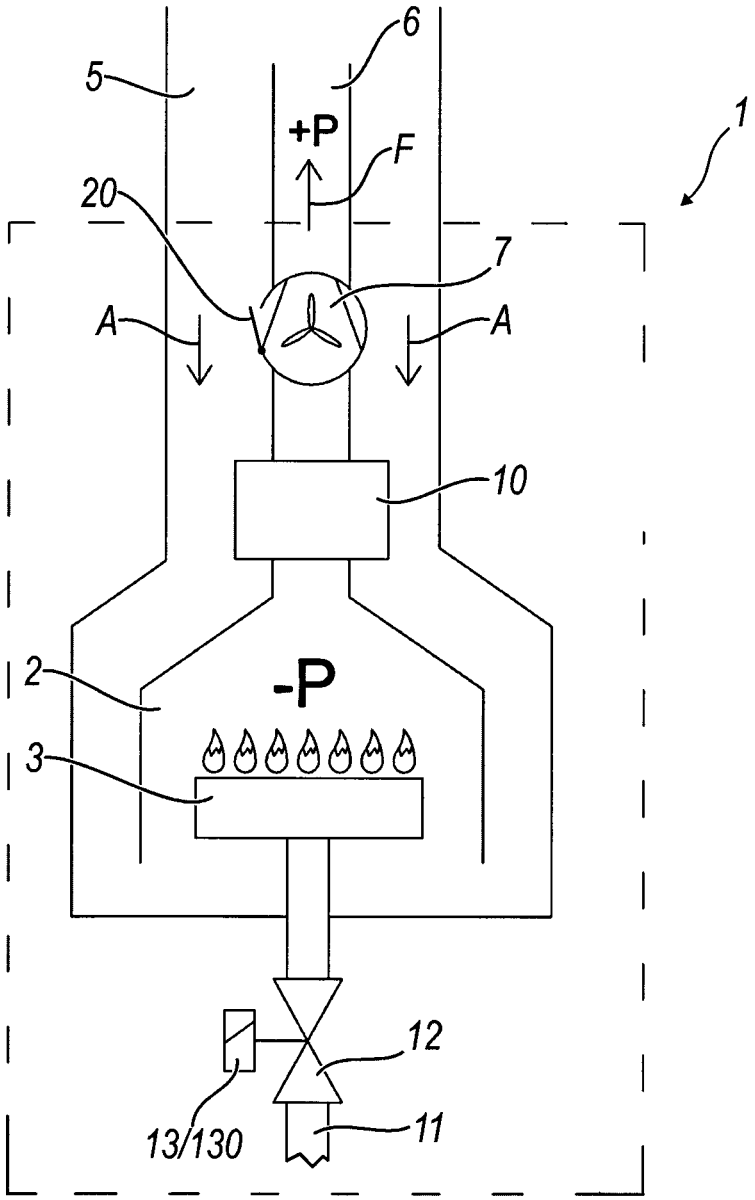
FIG. 5 shows diagrammatically a fifth embodiment of the boiler in FIG. 1.

Valve member 18 may be of the manually adjustable type (FIGS. 2 and 4) or of the fixed adjustment type as illustrated in FIG. 3. In both cases member 18 is set to allow a predetermined quantity of flue gases to pass from exhaust conduit 6 to feed conduit 5. This quantity is initially defined at the design stage and is subsequently set during the production stage of the boiler, and where necessary adjusted when the boiler is installed or when maintenance work is carried out, according to the characteristics of the boiler or what is found (nitrogen oxides) in the flue gases leaving the combustion chamber.

As an alternative flue gases F may be drawn directly from the body of fan 7 when this is located (as in FIG. 5) directly on conduit 6 discharging flue gases F. In this case the said fan has a hole 20 in its body which connects its interior (in a zone at a pressure greater than conduit 6 in which it is mounted and where the exhaust flue gases pass through) to feed conduit 5 (or feed chamber) so as to allow a portion of these flue gases F to enter the latter and combine with the combustion air which is being drawn or injected into the combustion chamber.

The quantity of flue gases F which can pass between the first conduit or feed conduit 5 is defined by the cross-section of hole 20 (in addition to the pressure difference).

Figure 6:
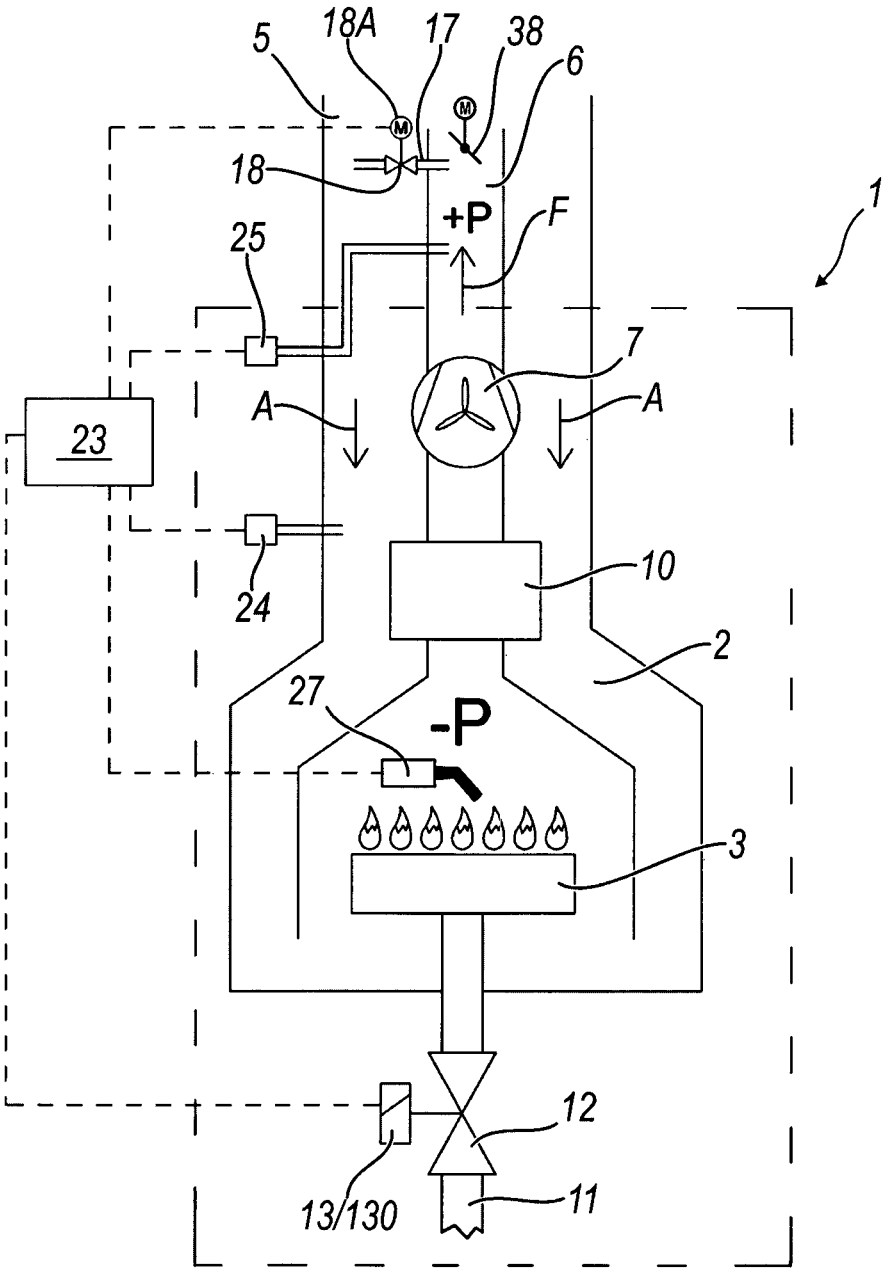
FIG. 6 shows diagrammatically a sixth embodiment of the boiler in FIG. 1.

FIG. 6 illustrates a further variant. In this figure, where parts corresponding to those in the previous figures are indicated using the same reference numbers, the connection between conduits 5 and 6 is always again through conduits 17 on which a valve member 18 is fitted. Unlike the solutions previously described, however, this valve member is motor-driven (or comprises an electric actuator, for example a motor 18A) so that the flow of flue gases from second conduit 6 to the first can be adjusted in a controllable way.

More particularly the solution in the figure in question comprises an electronic control unit 23 which is capable of monitoring the combustion taking place in chamber 2 through sensors 24 and 25 which detect the pressures of the flows of fluids passing respectively through feed conduit 5 and exhaust conduit 6 and a flame signal detector 27 (in itself known) which enables such units to detect the operating characteristics of burner 2. As an alternative, or in addition, control may be applied through one or more combustion sensors 24, 25, that is sensors which measure a datum identifying the composition of the flue gases, such as for example an oxygen sensor, a carbon monoxide sensor, or the like. Electronic unit 23 is connected to and controls electric actuator 18A (for example a motor) in a manner in which it is connected to the regulator, in this case, electric/electronic regulator 130 for valve 12 located on gas conduit 11.

In this way, unit 23 controls the opening and closing of valve 18 on the basis of the data obtained by aforesaid detector 27 (and/or the data obtained by pressure or flow or combustion sensors 24 and 25) acting on electric actuator 18A so as to allow controlled and "calibrated" passage of part of the pressure of the flue gases present in second conduit 6 into first (feed) conduit 5; this with the object of controlling the emission of harmful gases from boiler 1 continuously and in real time, having regard to the actual feed of gas to the burner and the latter's operating characteristics (obtained through detector 27).

The solution in question does not therefore require any manual adjustment of valve 18 and on the basis of data stored in a memory of unit 23 in respect of correlations between the monitored parameters (pressure of the flows of fluid monitored through sensors 24, 25, the flow of gas controlled through the adjustment of valve 12, the quality of combustion monitored through detector 27) and the actual composition of flue gases F in order to control the level of NOx present in exhaust flue gases F through adjusting the opening (or closing) of the aforesaid valve. All this in real time. This takes place by comparing the data obtained from each sensor with data defined during the design stage deriving from characterisation of the application.

Figure 7:
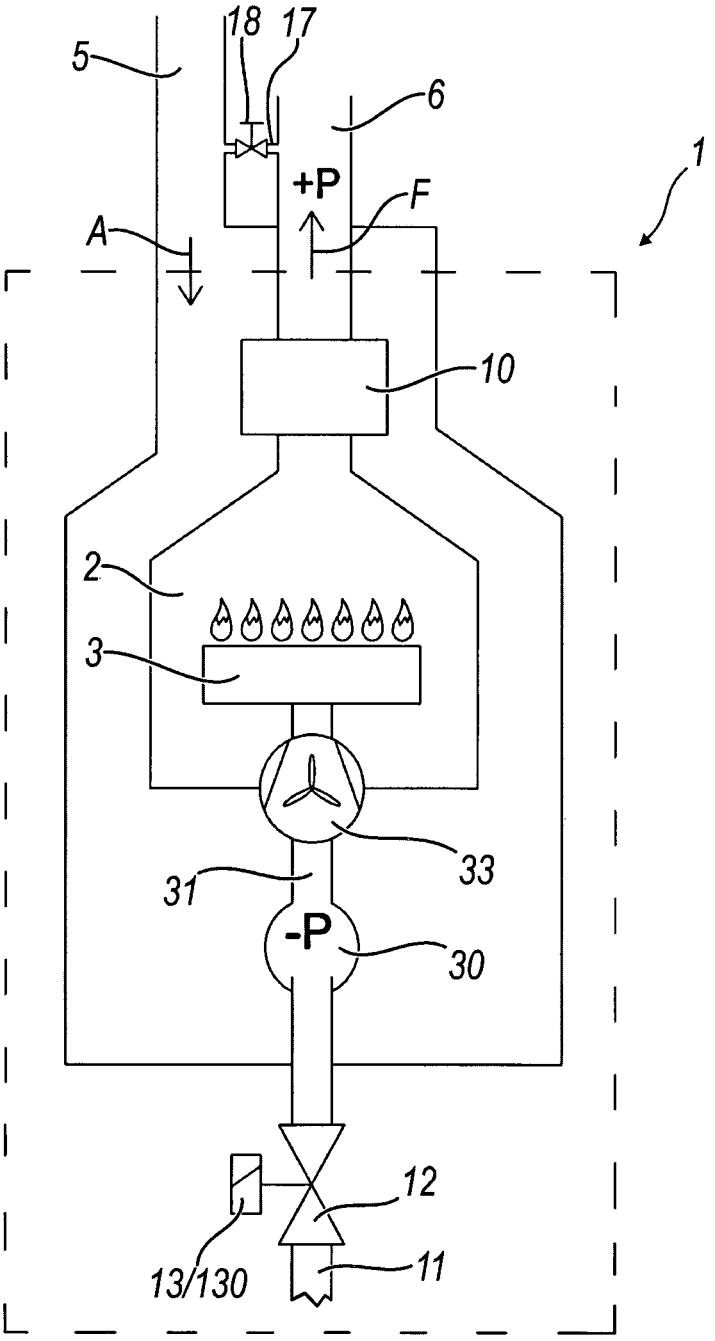
FIG. 7 shows diagrammatically a first embodiment of boiler with upstream mixing and predominantly primary air.
Figure 8:
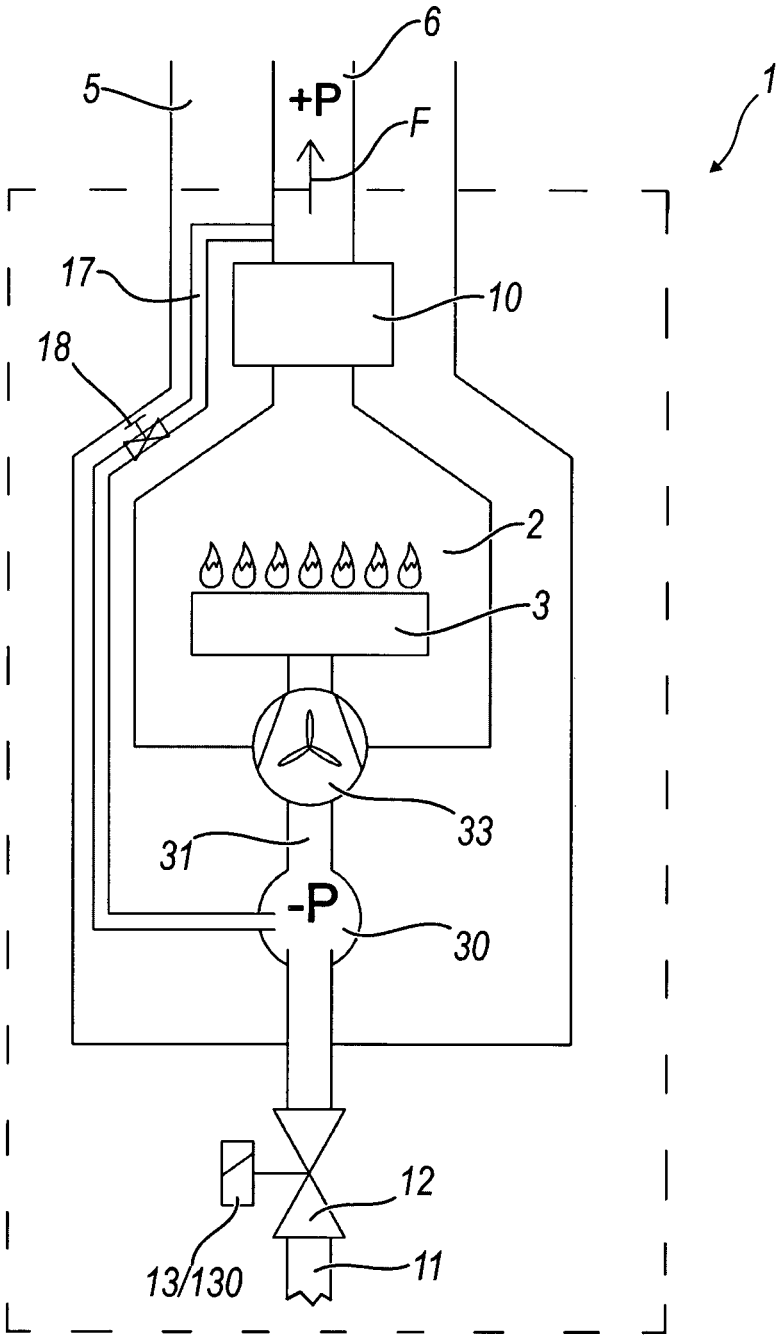
FIG. 8 shows diagrammatically a second embodiment of the boiler in FIG. 7.

In FIGS. 7 and 8, where parts corresponding to those already described are indicated by the same reference numbers, illustrate solutions of the invention applied to a boiler with predominantly primary air combustion. In this case first feed conduit 5 carries the combustion air to a mixing member 30 to which gas conduit 11 leads and from which a conduit 31 leaves to carry the air-gas mixture produced to burner 3 (through a fan 33 located upstream of the latter in the flow path of the mixture).

The solution in FIG. 7 provides that conduit 17 on which valve or valve member 18 is located lies between conduits 5 and 6, separate from the outlet from the boiler, while in the case of the solution in FIG. 8 conduit 17 directly connects exhaust conduit 6 to mixing member 30 so as to deliver the portion of flue gas drawn directly to the latter. In this, this portion is mixed with the combustion air and the gas. Again in this case valve member or valve 18 is used to adjust the quantity of flue gas which can pass into mixer 33 (which gives rise to negative pressure with respect to exhaust conduit 6, where the pressure is instead positive).

The solutions in FIGS. 7 and 8 may also have a variant similar to that in FIG. 6 where a control unit connected to sensor members and detectors acts on valve 18, adjusting its opening in relation to the need to maintain the harmful gases (mainly NOx) at low levels during the various operating stages of the boiler (continuously monitored).

In equipment with burners known on the market and defined above as being "low NOx", without premixing but using predominantly primary air, the invention overcomes one of the major problems limiting their use. Use of the invention provides advantages for this type of application in that injection of some of the combustion products upstream of the burner helps to cool its surface making it possible to use it with a range of adjustment which is sufficient for the burner to be used without the need to pass tubes carrying cooling water within it; this simplifies construction and reduces the final cost of the product.

Various embodiments of this invention have been described. Yet others are however possible. For example a flow reducer 38 (for example a fixed opening diaphragm or shutter with an adjustable opening) located in the second conduit or exhaust conduit 6 may be provided in addition to or as an alternative to valve member or valve 18 located in conduit 17 to vary (or increase) the value of the pressure in conduit 6 and assist passage of a portion of the flue gases into conduit 5. This solution is illustrated in FIGS. 1 and 3.

According to another variant illustrated in FIG. 3, as an alternative or in addition to reducer 38 fitted in conduit 6 as mentioned above provision may be made for a flow reducer (38A) in conduit 5 such as to vary (in this case reduce) the negative pressure present downstream of the conduit itself (in combustion chamber 2 or mixer 30) and thus cause greater "suction" of the flue gases through opening 15 or conduit 17 (which may or may not be provided with valve 18).

This flow regulator 38, 38A located in exhaust conduit 5 and/or feed conduit 6 may be manually adjusted or electrically operated (for example motor-driven) in order to automatically adjust the recycling of exhaust flue gases (in addition or as an alternative to valve member 18 alone operated by motor 18A) through unit 23 and the use of one or more sensors (24, 25, 27) in a similar manner to that described previously.

As a further characteristic, the automatic system providing for control unit 23 may have no pressure or flow or combustion sensors (24, 25) and use only sensor 27 which measures the flame signal (a technique in itself known); the signal detected by this sensor is used by unit 23 as an element for checking the combustion process (flue gas composition) with consequent action, if necessary, on the opening or closing or partial opening of valve 18 and/or on the speed of the fan in order to achieve the desired result in terms of combustion, or simply stopping the system if combustion should depart from the optimum parameters. This is achieved through comparing the data obtained by flame sensor 27 with those defined during the design stage or deriving from characterisation of the application. The same result can be achieved using a combustion sensor ($O_2$, CO, etc.) in addition or as an alternative to the flame sensor, as a measure of the quality of combustion (or the fact that the latter has parameters falling within the limits specified by current regulations).

Finally the system for determining the amount of flue gases which have to be recycled may have automatic regulation of the "mechanical-pneumatic" type. The recycling flow regulator may be constructed so as to vary the quantity of recycled flue gases in relation to the flow of combustion air (for example by varying the pressure, or delta-pressure, in the conduit). In this way, for example, it is possible to vary (reduce) the quantity of recycled flue gases automatically if the flow of combustion air is reduced either deliberately, through adjusting the rotation speed of the fan by means of electronic control, or undesirably, for example, through (partial or total) blocking of the conduit.

Further variants and embodiments of the invention may be made by those skilled in the art on the basis of the above description and are therefore to be regarded as falling within the scope of the following claims.

The invention claimed is:

1. A method for reducing harmful gas emissions from a gas-fired boiler comprising a sealed forced-draught combustion chamber in which there is a burner to which is led a first conduit for drawing in combustion air and from which departs a second conduit for discharging combustion flue gases or exhaust gases, comprising:

drawing a portion of the flue gases or exhaust gases through a connecting conduit from the second conduit and injection of the portion of the flue gases or exhaust gases from the second conduit into the combustion air to reduce the percentage of atmospheric oxygen present in that combustion air and consequently reduce the generation of harmful gases in the combustion flue gases, the portion of flue gases or exhaust gases drawn off being (a) injected into the first conduit drawing in the combustion air, the portion of flue gases or exhaust gases being drawn off from the second conduit to the first conduit through the connecting conduit connecting the first and second conduits or (b) being passed into a mixing member in the boiler where combustion air and the flue gas are mixed before they are delivered to the combustion chamber, the portion of flue gases or exhaust gases being drawn off from the second conduit into the mixing chamber through the connecting conduit connecting the second conduit and the mixing member, said connecting conduit having a motor driven valve member, provision being made for adjusting the valve member to obtain a passage of a desired quantity of the flue gases or exhaust gases through the connecting conduit, the adjustment of the valve member taking place, either in a definitive and fixed manner or in a repeatable manner, through an automatic intervention comprising detecting at least one signal from the group consisting of a flame sensor for detecting flame of the burner and flow and/or pressure or combustion sensors in the combustion air and the flue gases or exhaust gases to adjust opening of the valve member to adjust the draw-off of the flue gases or exhaust gases from the second conduit according to the operating conditions of the boiler, wherein to control the quantity of flue gases or exhaust gases transferred into the combustion air through the connecting conduit, control means for controlling the motor driven valve member are connected to one or more said sensors.

2. A gas-fired boiler with a sealed forced-draught combustion chamber containing a gas burner, the boiler comprising a first conduit or feed conduit for the combustion air and a second conduit or exhaust conduit connected to the combustion chamber capable of carrying the flue gases or exhaust gases therefrom, transfer means making it possible for part of the flue gases or exhaust gases to pass into the combustion air directed towards the chamber before the flue gases or exhaust gases reaches the chamber, said transfer means being:

a connecting conduit alternatively connecting the first and second conduits or connecting the second conduit with a mixer which is reached by the gas and combustion air and from which there leaves a mixture of fluids directed towards the burner, said connecting conduit being provided with a motor driven intercepting valve member provided with an electric actuator, and control means for monitoring the function of the boiler which are capable of adjusting opening of the valve member to adjust the quantity of flue gases or exhaust gases transferred into the combustion air through the connecting conduit, means for detecting at least one signal from the group consisting of a flame sensor for detecting flame of the burner and flow and/or pressure or combustion sensors in the combustion air and the flue gases or exhaust gases to adjust opening of the valve member;

wherein to control the quantity of flue gases or exhaust gases transferred into the combustion air through the connecting conduit, the control means are connected to one or more said sensors, the control means being connected and controlling the valve member to adjust the quantity of flue gases or exhaust gases from the second conduit transferred into the combustion air according to the operating conditions of the boiler.

3. The boiler according to claim 2, wherein the control means comprises electronic control means connected to the sensors which detect the pressure of the flows of fluids passing through the first and second conduits.

4. The boiler according to claim 2, wherein alternatively the boiler is of the type with an atmospheric or "low NOx" burner using predominantly primary air with or without water cooling.

5. The boiler according to claim 2, wherein to control the quantity of flue gases or exhaust gases transferred into the combustion air, the control means are connected to one or more sensors of the flue gas flow or combustion pressure or alternatively one or more sensors of the signal obtained from the sole flame sensor or alternatively to a sensor detecting the flame signal or one or more flow, pressure or combustion sensors.

6. The boiler according to claim 2, wherein to control the quantity of flue gases or exhaust gases transferred into the combustion air, the control means being alternatively connected to electrically operated members subdividing the inlet flow and/or outlet flow or to electrically operated members subdividing the inlet flow and/or outlet flow and flow through a gas valve or to electrically-operated members subdividing the inlet flow and/or outlet flow and acting on the gas valve and/or rotation speed of a fan located at the second conduit opening directly into the first conduit or only to the gas valve to allow control of the flow of flue gas and/or to the fan whose rotation speed is controlled, the control means adjusting the quantity of flue gases or exhaust gases transferred into the combustion air through the connection or as an alternative acting to reduce the flow of flue gas when it is found through the abovementioned sensors that combustion is not within the parameters defined by current regulations.

7. The method according to claim 1, wherein the adjustment of the valve member is carried out on the basis of a monitored parameter defined by a flame signal.

8. The method according to claim 1, wherein the adjustment of the valve member is carried out on the basis of a monitored parameter defined by a signal relating to the pressure and/or flow of fluids passing respectively through the first conduit and the second conduit.

9. The method according to claim 1, wherein the adjustment of the valve member is carried out on the basis of a monitored parameter generated by a combustion sensor.

10. The method according to claim 1, wherein a control of the actual feed of fuel gas to the combustion chamber is provided during the adjustment of the valve member.

11. The method according to claim 1, wherein the adjustment of the valve member is carried out on the basis of data stored in a memory of an electronic control unit in respect of correlations between the monitored parameter and the actual composition of the flue gas in order to control the level of NOx present in the exhaust flue gases through the adjustment of the opening of said valve member.

12. The method according to claim 1, wherein the adjustment of the valve member is carried out in real time.

13. The boiler according to claim 2, wherein the control means comprises electronic control means connected to a sensor detecting the flame signal which detects the operating characteristics of the gas burner.

14. The boiler according to claim 2, wherein the control means comprises electronic control means connected to electrically operated members subdividing the inlet flow and/or outlet flow.

15. The boiler according to claim 2, wherein the control means comprises electronic control means connected to a gas valve so as to allow control of the flow of flue gas and/or to a fan located into the second conduit whose rotation speed is controlled, the electronic control means adjusting the quantity of flue gases or exhaust gases transferred into the combustion air through the connection or as an alternative acting to reduce the flow of flue gas when it is found that combustion is not within the parameters defined by current regulations.

* * * * *